US009850757B2

(12) United States Patent
Bergmann

(10) Patent No.: US 9,850,757 B2
(45) Date of Patent: Dec. 26, 2017

(54) AXIAL PISTON MACHINE UTILIZING A BENT-AXIS CONSTRUCTION

(71) Applicant: Linde Hydraulics GmbH & Co. KG, Aschaffenburg (DE)

(72) Inventor: Martin Bergmann, Schaafheim (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 394 days.

(21) Appl. No.: 14/673,968

(22) Filed: Mar. 31, 2015

(65) Prior Publication Data

US 2015/0285075 A1 Oct. 8, 2015

(30) Foreign Application Priority Data

Apr. 8, 2014 (DE) ..... 10 2014 104 951

(51) Int. Cl.

| | |
|---|---|
| ***F01B 13/04*** | (2006.01) |
| ***F01B 3/00*** | (2006.01) |
| ***F04B 1/12*** | (2006.01) |
| ***F04B 53/14*** | (2006.01) |
| ***F03C 1/28*** | (2006.01) |

(52) U.S. Cl.

CPC ..... *F01B 3/0002* (2013.01); *F01B 3/0094* (2013.01); *F03C 1/0605* (2013.01); *F04B 1/126* (2013.01); *F04B 53/147* (2013.01)

(58) Field of Classification Search

CPC ..... F04B 1/124; F04B 1/126; F01B 3/0088
See application file for complete search history.

(56) References Cited

U.S. PATENT DOCUMENTS

| | | | | |
|---|---|---|---|---|
| 2,947,182 | A * | 8/1960 | Wahlmark | F01B 3/0088 92/71 |
| 3,871,782 | A * | 3/1975 | Johansson | F01B 3/0088 403/122 |
| 3,943,828 | A | 3/1976 | Wagenseil | |
| 4,644,850 | A * | 2/1987 | Kanamaru | F04B 27/0821 91/499 |
| 5,114,261 | A | 5/1992 | Sugimoto et al. | |
| 7,357,067 | B2 * | 4/2008 | Galba | F04B 1/124 92/71 |

(Continued)

FOREIGN PATENT DOCUMENTS

| | | |
|---|---|---|
| DE | 4024319 A1 | 2/1991 |
| EP | 0186913 A2 | 7/1986 |
| EP | 0567805 A1 | 11/1993 |

(Continued)

*Primary Examiner* — Michael Leslie
(74) *Attorney, Agent, or Firm* — The Webb Law Firm

(57) ABSTRACT

A hydrostatic axial piston machine (1) has a cylinder barrel (7) with a plurality of piston bores having pistons (10) fastened in an articulated manner to a drive flange (3). For articulated fastening of the pistons (10) to the drive flange (3), ball joints (20) are provided that are formed by a spherical cap-shaped receptacle socket (3*a*) in an end surface (3*b*) of the drive flange (3) and a ball head (10*a*) that is operatively connected with the piston (10). The receptacle sockets (3*a*) are each in the form of hemispheres that extend to the ball equator, and on one end surface (3*b*) of the drive flange (3), in the vicinity of the receptacle sockets (3*a*), there is a retaining web (30) that extends beyond the ball equator of the hemisphere to grip the ball head (10*a*) at an angle of greater than 180°.

16 Claims, 8 Drawing Sheets

(56) References Cited

U.S. PATENT DOCUMENTS 7,363,849 B2 4/2008 Kurz et al.

FOREIGN PATENT DOCUMENTS

| | | | |
|---|---|---|---|
| EP | 0697520 | A1 | 2/1996 |
| EP | 1071884 | B1 | 1/2001 |
| EP | 1750009 | A1 | 2/2007 |
| WO | 2004109107 | A1 | 12/2004 |

* cited by examiner

A-A
B-B
10
10a
10b
10c
13
40a
40b
45
46
33
3
3a
3b
3d
30, 30a, 32
30, 30b, 32
30, 30b
30, 30a
E
D
M
N
K
L
T
C

10a
LK
40a
10
30d
30
45
36
46
3d
3
3a

10a
LK
40a
10
36
45
46
3
3a

N
βM
10
LK
10a
βp
40a
36
45
10c
46
3
3a

β1
10
LK
36
45
46
3
40a
3a 10a
40a
30,30b
30,30a
37
45
36
30d 30,30b
10b
40a
37
10c
10
3,36
30,30a
45

40b
10a
40a
36
30d
30,30b
30,30a 10b
40a
33
10c
10
3,36
46
37
30,30a
45

30,30b
30d
40b
10a
40a
36
30d
30,30a 30,30b
10b
33
10c
10
36
3
37
30,30a 30,30b
33
30d
40b
10a
40a
36
30d
30,30a 33
10a
30,30b
10
10c
36
3
45
37
30,30a

AXIAL PISTON MACHINE UTILIZING A BENT-AXIS CONSTRUCTION

CROSS REFERENCE TO RELATED APPLICATIONS

This application claims priority to German Application No. DE 102014104951.9 filed Apr. 8, 2014, which is herein incorporated by reference in its entirety.

BACKGROUND OF THE INVENTION

Field of the Invention

This invention relates to a hydrostatic axial piston machine utilizing a bent-axis construction having a drive shaft located inside a housing so that it can rotate around an axis of rotation, a drive flange located inside the housing so that it can rotate around an axis of rotation, and a cylinder barrel located inside the housing of the axial piston machine so that it can rotate around an axis of rotation. The cylinder barrel has a plurality of piston bores, in each of which is located a longitudinally displaceable piston. The pistons are fastened to the drive flange in an articulated manner by ball joint connections formed by a spherical cap-shaped receptacle socket in one end surface of the drive flange and a ball head in an operative connection with the piston.

Description of Related Art

In hydrostatic axial piston machines utilizing a bent-axis construction, the longitudinally displaceable pistons located in the cylinder barrel are generally fastened to the drive flange of the drive shaft by a ball joint. The piston forces are transmitted by the piston to the drive flange located on the drive shaft and generate a torque. In axial piston machines utilizing a bent-axis construction, it is necessary to fasten the pistons to the drive flange in an articulated manner. For this purpose, a ball joint connection is used that consists of a spherical cap-shaped receptacle socket in one end surface of the drive flange and a ball head located on the piston and inserted into the receptacle socket of the drive flange.

In operation, the ball heads of the pistons must be held in place in the respective receptacle sockets of the drive flange.

WO 2004/109107 A1 describes a hold-down plate with openings for the piston heads and spherical caps formed on the openings threaded over the pistons and bolted to the drive flange.

Because of the need for the hold-down plate, which is complex and expensive to manufacture on account of the spherical caps and the threaded connectors that are required to bolt the hold-down plate to the drive flange, axial piston machines of this type are complex and expensive to construct.

To eliminate the effort required for the construction of the additional hold-down plate, EP 0 567 805 B1, EP 1 071 884 B1, DE 40 24 319 A1 and EP 0 697 520 B1 teach that the ball heads can be positively secured in the spherical cap-shaped receptacle sockets. The spherical cap-shaped receptacle socket has a wrapping angle greater than 180 degrees, so that the receptacle sockets wrap around the ball equator, and the ball heads have a cylindrical surface area, e.g., by flattening or machining of the ball head, so that the ball head is inserted into the spherical cap-shaped receptacle socket in a defined position by the cylindrical surfaces, and can then be secured in the receptacle socket by tilting. The manufacture of the components is thereby simplified and makes possible an easy assembly of the pistons with the ball heads in the receptacle sockets of the drive flange.

In EP 0 567 805 B1 and EP 1 071 884 B1, the cylindrical surfaces are oriented parallel to the longitudinal axis of the pistons so that during assembly, the pistons are threaded into the receptacle sockets coaxially to the axis of rotation of the drive flange. When the pistons are tilted to the working angle, the piston heads are locked in position in the receptacle shells. In bent-axis machines in the form of variable displacement machines, when the pistons are locked in position in the receptacle sockets in this manner, the coverage of the ball heads in the receptacle sockets can become too small as the pivoting angle of the cylinder barrel decreases. Thus, these methods of locking the ball heads of the pistons in the drive flange are suitable only under certain conditions for use in variable displacement machines with a variable pivoting angle of the cylinder barrel. These locking mechanisms are not suitable for use in variable displacement machines with a pivoting angle of 0° because the pistons can no longer be securely held in the receptacle sockets and can fall out of the receptacle sockets.

In DE 40 24 319 A1 and EP 0 697 520 B 1, the cylindrical surfaces are oriented at an angle with respect to the longitudinal axis of the pistons. The angle of inclination of the cylindrical surfaces is such that this angle does not occur during operation of the axial piston machine. Therefore, this locking mechanism is suitable for use on variable displacement machines and makes it possible to lock the pistons in the receptacle sockets of the drive flange even at a pivoting angle of 0°. For the installation of the pistons in the drive flange, the pistons must be tilted sharply, in which case it may be necessary to provide a recess (which is complex and expensive to manufacture) on each receptacle socket as an opening or recess for the piston rod of the piston. Depending on the installation angle of the pistons, this recess in the receptacle socket of the drive flange necessary for the installation of the pistons can extend to the equator of the ball, as a result of which the surface area of the spherical cap-shaped receptacle socket is significantly reduced.

In the axial piston machines described in EP 0 567 805 B1, EP 1 071 884 B1, DE 40 24 319 A1 and EP 0 697 520 B1, as a result of the wrapping angle of more than 180° of the spherical cap-shaped receptacle sockets, there is a correspondingly high thickness of the drive flange. This takes up a correspondingly large amount of space in the axial direction of the axial piston machine because the rotating cylinder barrel with the end surface containing the piston outlet openings may not come into contact with the end surface of the drive flange in which the receptacle sockets are located.

Therefore, it is an object of this invention to provide an axial piston machine utilizing a bent-axis construction in which the locking of the pistons in the drive flange is easier to manufacture and makes it possible to reduce the axial dimensions of the axial piston machine.

SUMMARY OF THE INVENTION

This problem is solved according to the invention in that the receptacle sockets are each in the form of hemispheres that extend to the equator of the ball. A retaining web is shaped on one end surface of the drive flange, in the vicinity of the receptacle sockets, that extends beyond the ball equator of the hemisphere to grip the ball head over an angle greater than 180°. In the axial piston machine of the invention, the receptacle sockets in the form of a hollow sphere in the drive flange are only hemispheres that extend to the equator of the ball. To secure the ball heads in these hemispheric receptacle sockets in a positive or form-fitting manner, on the end surface of the drive flange, in the vicinity of the receptacle sockets, there is a retaining web that projects beyond the end face of the drive shaft and extends beyond the ball equator of the hemisphere. The wrapping of the ball heads beyond the ball equator occurs only in the vicinity of the retaining web, so that only the retaining web located on the end surface of the drive flange secures the pistons in the receptacle sockets and forms the retaining mechanism for the pistons. As a result of the spatial limitation of the retention of the ball heads to the area of the retaining web located on the end surface of the drive flange, it becomes possible to reduce the thickness of the remaining area of the end surface of the drive flange with respect to the retaining web, so that an open space or recess is created and the cylinder barrel with the end surface containing the piston outlet openings can be brought closer to the drive flange. This makes it possible to reduce the axial space requirement of the axial piston machine. Compared to known axial piston machines that employ a bent-axis construction, in the axial piston machine of the invention, on account of the spatial limitation to the retaining web of the retention of the pistons in the receptacle sockets, the construction effort and expense can also be reduced.

In one advantageous embodiment of the invention, the retaining web forms two retaining segments on each receptacle socket, which are located opposite one another on the receptacle socket and extend beyond the hemisphere. With two opposed retaining segments, it becomes possible in a simple manner to grasp the ball head in the vicinity of the equator to hold the ball head in the receptacle socket in a positive or form-fitting manner.

With regard to a reduced construction effort and expense, it is particularly advantageous if the retaining web is formed by a circular ring-shaped elevation on the end surface of the drive flange. A ring-shaped elevation on the end surface requires little additional construction effort or expense. In addition, breaks between the segments of the ring-shaped elevation can be formed in a simple manner during the manufacture of the hemispheric receptacle sockets in the drive flange so that two retaining segments located opposite each other can be formed on each receptacle socket.

It is particularly advantageous if the center point of the circular ring-shaped elevation that forms the retaining web is located on the axis of rotation of the drive flange. As a result of this concentric orientation of the circular ring-shaped elevation and the axis of rotation of the drive flange, the contour of the circular ring-shaped elevation can be easily and economically manufactured by lathe turning.

The circular ring-shaped elevation is advantageously located in the vicinity of a reference circle on which the centers of the hemispheres are located. In this manner, a secure retention of the ball heads in the receptacle sockets by the retaining web can be achieved. This measure also creates a corresponding open space or recess that makes it possible to move the cylinder barrel close to the drive flange to achieve compact axial dimensions of the axial piston machine.

With regard to the simple manufacture of the axial piston machine, it is particularly advantageous if the retaining web is formed in one piece with the end surface of the drive flange. If the retaining web is formed with an appropriate machining allowance on a blank of the drive flange, the drive flange and the retaining web can be easily and economically manufactured as a lathe-turned part by machining on a lathe.

To be able to install the ball heads in the corresponding receptacle sockets, in one advantageous development of the invention, each ball head is provided with two grooves located opposite each other. The distance between the groove bases of the two grooves is less than the width of the opening formed by the two retaining segments on the respective receptacle socket. This makes it possible in a simple manner to thread the ball heads into the receptacle socket utilizing the two grooves between the retaining segments, thereby achieving a simple installation of the pistons in the receptacle sockets.

The width of the grooves is advantageously greater than the width of the retaining web. As a result of the two opposed grooves, which like the retaining web have only a small width, the ball half (hemisphere) of the ball head that transmits the piston force is reduced only negligibly in terms of surface area by the relatively small width of the two grooves, so that high cylinder forces can be transmitted.

The grooves can be oriented perpendicularly or parallel to the longitudinal axis of the piston. It is particularly advantageous if the grooves on the ball head are inclined at an angle with respect to the longitudinal axis of the piston. Depending on the angle of inclination of the grooves, it is possible in the axial piston machine of the invention to omit the recesses in the receptacle sockets for the piston rods for installation of the pistons. This is because with the end surface of the drive flange set back with respect to the retaining web, a corresponding open space is already created for the piston rods for installation of the pistons. If, with a correspondingly high angle of inclination of the grooves, a recess is necessary to provide the necessary open space on the inside of the drive flange in the vicinity of the receptacle sockets for the piston shaft of the piston to make it possible to install the pistons in the drive flange, in the axial piston machine of the invention, compared to known axial piston machines, the depth of the recess is smaller and, thus, so is the recess in the end surface of the drive flange. Preferably, the grooves are not oriented perpendicular to the longitudinal axis of the pistons, as a result of which, compared to perpendicularly oriented grooves, there are smaller recesses in the receptacle sockets for the piston rods for the installation of the pistons. On account of smaller recesses for the piston rod of the pistons, the surface area of the spherical cap of the receptacle socket in which the piston force is transmitted is reduced only slightly in the axial piston machine of the invention. In addition, because the grooves are oriented at an angle, the locking of the pistons in the drive flange is suitable for bent-axis machines with a pivoting angle of 0°.

The angle of inclination of the grooves is advantageously selected so that the angle of inclination is different from the tilting angles of the pistons that occur during operation of the axial piston machine. The angle of inclination is advantageously selected so that during installation, the inclination of the pistons toward the axis of rotation of the drive flange is greater than the maximum inclination of the pistons that occurs during operation, so that during operation of the axial piston machine the pistons can be securely and positively held with the ball heads in the receptacle sockets of the drive flange.

On the drive flange on each receptacle socket there is advantageously a recess for a piston rod of the piston, to achieve an easy installation of the piston in the drive flange with grooves oriented at an angle.

In one advantageous embodiment of the invention, a spherical guide is located between the drive flange and the cylinder barrel for the guidance of the cylinder barrel. With a spherical guide of this type, which is preferably formed by a spherical segment of the drive flange or of the drive shaft and a segment of the cylinder barrel in the form of a hollow sphere, a simple, economical and space-saving guidance and mounting of the cylinder barrel can be achieved.

The recesses are advantageously formed on the radially outer portion of the receptacle socket in the end surface of the drive flange. On an axial piston machine with a spherical guidance of the cylinder barrel, recesses located on the radially outer portion make possible a simple installation of the pistons by tilting the pistons radially outwardly.

If the drive flange is provided with a bevel on the outer edge of the end surface having dimensions such that the bevel forms the recess for the piston rod of the piston, the optional recess for the piston rod of the piston can be manufactured as an opening or recess without additional manufacturing effort or expense.

The grooves in the ball heads of the pistons can run in a straight line.

Particular advantages become possible if the grooves follow a bent path. Compared to grooves that run in a straight line, grooves that follow a bent path make it possible for the load-bearing half (hemisphere) of the ball head to have a larger area so that higher piston forces can be transmitted.

The grooves advantageously have a first section that is oriented at an inclination with respect to the longitudinal axis of the piston and a second section that is bent with respect to the first section, in particular perpendicularly to the longitudinal axis of the piston.

BRIEF DESCRIPTION OF THE DRAWINGS

Additional advantages and details of the invention are described in greater detail below on the basis of the exemplary embodiments illustrated in the accompanying schematic figures, in which like reference numbers identify like parts throughout.

DESCRIPTION OF THE PREFERRED EMBODIMENTS

Figure 1:
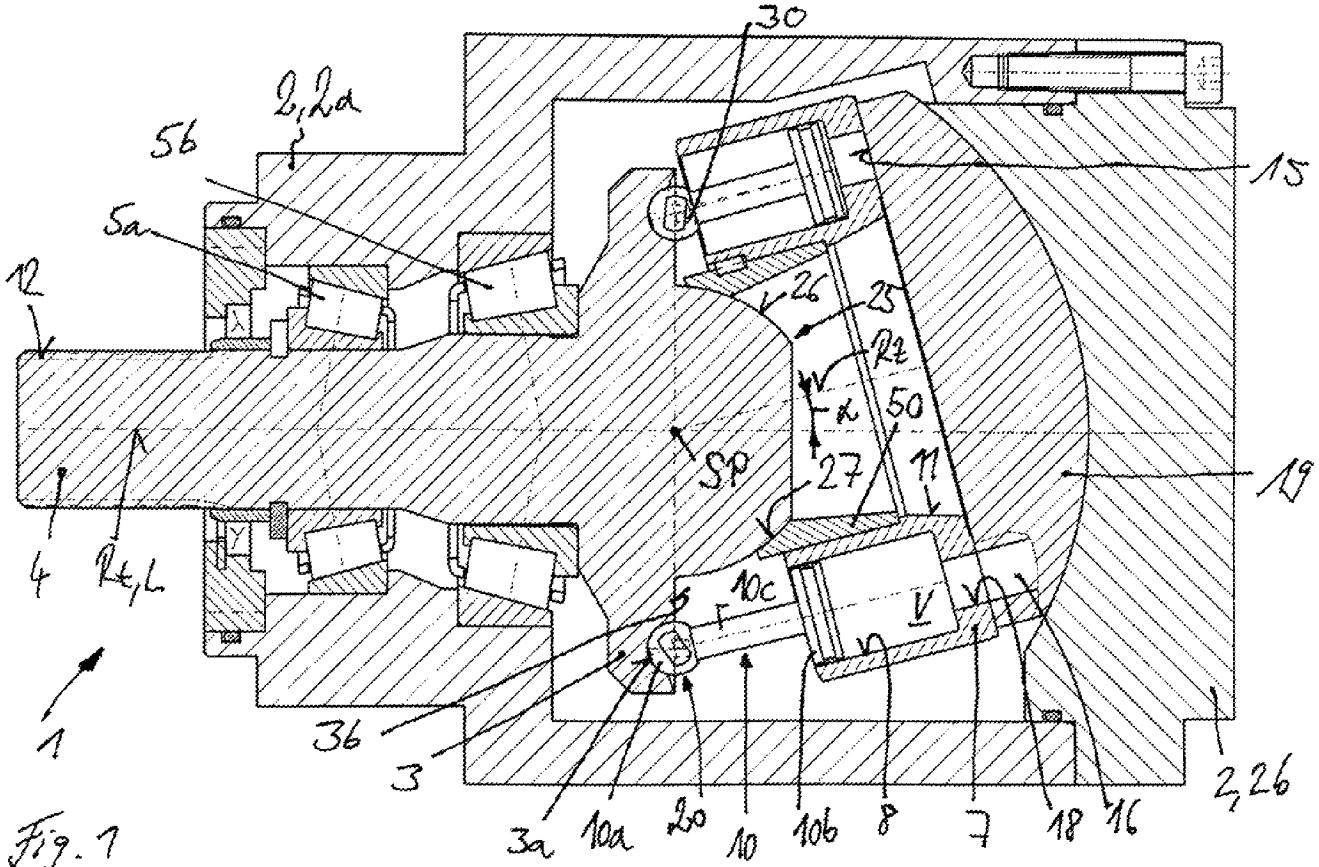
FIG. 1 illustrates an axial piston machine of the invention employing a bent-axis construction in a longitudinal section.

A hydrostatic axial piston machine 1 of the invention in the form of a bent-axis machine is illustrated in FIG. 1. The axial piston machine 1 has a housing 2 that includes a housing assembly 2*a* and a housing cover 2*b* that is fastened to the housing assembly 2*a*. Located in the housing are a drive flange 3 and a drive shaft 4 that can rotate around an axis of rotation $R_t$ that corresponds to a longitudinal axis L of the axial piston machine 1. In the illustrated exemplary embodiment, the drive shaft 4 is mounted by bearing devices 5*a*, 5*b* so that it can rotate around the axis of rotation $R_t$. In the illustrated exemplary embodiment, the drive flange 3 is formed in one piece with the drive shaft 4.

A cylinder barrel 7 is located in the housing 2 axially next to the drive flange 3. The cylinder barrel 7 rotates around an axis of rotation $R_Z$ and is provided with a plurality of piston bores 8 which, in the illustrated exemplary embodiment, are located concentric to the axis of rotation $R_Z$ of the cylinder barrel 7. A piston 10 is located so that it can move longitudinally in each piston bore 8.

The axis of rotation $R_t$ of the drive shaft 4 intersects the axis of rotation $R_Z$ of the cylinder barrel 7 at the intersection point SP.

The drive shaft 4 is equipped on the drive flange end with torque transmission means 12, such as splines, for the introduction of a drive torque or the tapping of an output torque.

For control of the feed and discharge of hydraulic fluid in the displacement chambers V formed by the piston bores 8 and the pistons 10 the cylinder barrel 7 is in contact with a control surface 15, which is provided with kidney-shaped control bores (not illustrated in any detail) which form an inlet connection 16 and an outlet connection of the axial piston machine 1. For connection of the displacement chambers V formed by the piston bores 8 and the pistons 10 with the control bores, the cylinder barrel 7 is provided with a control opening 18 at each piston bore 8.

The axial piston machine illustrated in FIG. 1 is a variable displacement machine with a variable displacement volume. On the variable displacement machine, the angle of inclination $\alpha$, and thus the pivoting angle of the axis of rotation $R_Z$ of the cylinder barrel 7, is variable with reference to the axis of rotation $R_t$ of the drive shaft 4 to vary the displacement volume. The control surface 15 with which the cylinder barrel is in contact is located on a cradle body 19 located in the housing 2 so that it can rotate around a pivoting axis that lies at the intersection point SP of the axis of rotation $R_t$ of the drive shaft 4 and the axis of rotation $R_Z$ of the cylinder barrel 7 and is oriented perpendicularly to the axes of rotation $R_t$ and $R_Z$.

Depending on the position of the cradle body 19, the angle of inclination $\alpha$ of the axis of rotation $R_Z$ of the cylinder barrel 7 varies relative to the axis of rotation $R_t$ of the drive shaft 4. The cylinder barrel 7 can be pivoted into a null position where the pivoting angle is 0°, in which the axis of rotation $R_Z$ of the cylinder barrel 7 is coaxial with the axis of rotation $R_t$ of the drive shaft 4. Starting from this null position, the cylinder barrel 7 can be pivoted to one or both sides, so that the axial piston machine illustrated in FIG. 1 can be a unilaterally or bilaterally pivotable variable displacement machine. A device for pivoting the cradle body 19, and thus the cylinder barrel 7, is not illustrated in detail in FIG. 1.

The pistons 10 are each fastened to the drive flange 3 in an articulated manner.

Between the respective piston 10 and the drive flange 3, there is a ball joint connection 20 in the form of a spherical joint 20. The ball joint 20 (illustrated in greater detail in FIG. 2) is formed by a ball head 10*a* of the piston 10 and a spherical cap-shaped (hollow spherical shaped) receptacle socket 3*a* which is formed in the end surface 3*b* of the drive flange facing the cylinder barrel 7, in which the piston 10 with the ball head 10*a* is fastened.

The pistons 10 can also each have a longitudinal bore 13 that runs through the piston 10, is in communication with the displacement chamber V, and extends through the ball head 10*a*, to hydrostatically relieve the ball joint 20.

The pistons 10 each have a collar section 10*b*, with which the piston 10 is positioned in the piston bore 8. A piston rod 10*c* of the piston 10 connects the collar segments 10*b* with the ball head 10*a*.

To make possible an equalization movement of the pistons 10 in the event of a rotation of the cylinder barrel 7, the collar segment 10*b* of the piston 10 is located in the piston bore 8 with some play. The collar segment 10*b* of the piston 10 can be spherical. To create a seal between the pistons 10 and the piston bores 8, sealing means 21, such as a piston ring, are located on the collar segment 10*b* of the piston 10.

For mounting and centering of the cylinder barrel 7, a spherical guide 25 is located between the cylinder barrel 7 and the drive flange 3 or the drive shaft 4, respectively. The spherical guide 25 is formed by a spherical segment 26 of the drive flange 3 or of the drive shaft 4 on which the cylinder barrel 7 is located and has a hollow spherical segment 27. The center of segments 26, 27 lies at the intersection point SP of the axis of rotation $R_t$ of the drive shaft 4 and the axis of rotation $R_Z$ of the cylinder barrel 7. In the illustrated exemplary embodiment, the hollow spherical segment 26 is located on the end surface of a sleeve-like bushing 50, which is located and fastened in a central longitudinal bore 11 of the cylinder barrel 7 and, therefore, in the interior of the cylinder barrel 7.

To drive the cylinder barrel 7 during operation of the axial piston machine 1, a drive device (not illustrated in detail) couples the drive shaft 4 and the cylinder barrel 7 in the direction of rotation. The drive device can be, for example, a drive linkage, such as a constant velocity joint.

Figures 3, 4, 5:
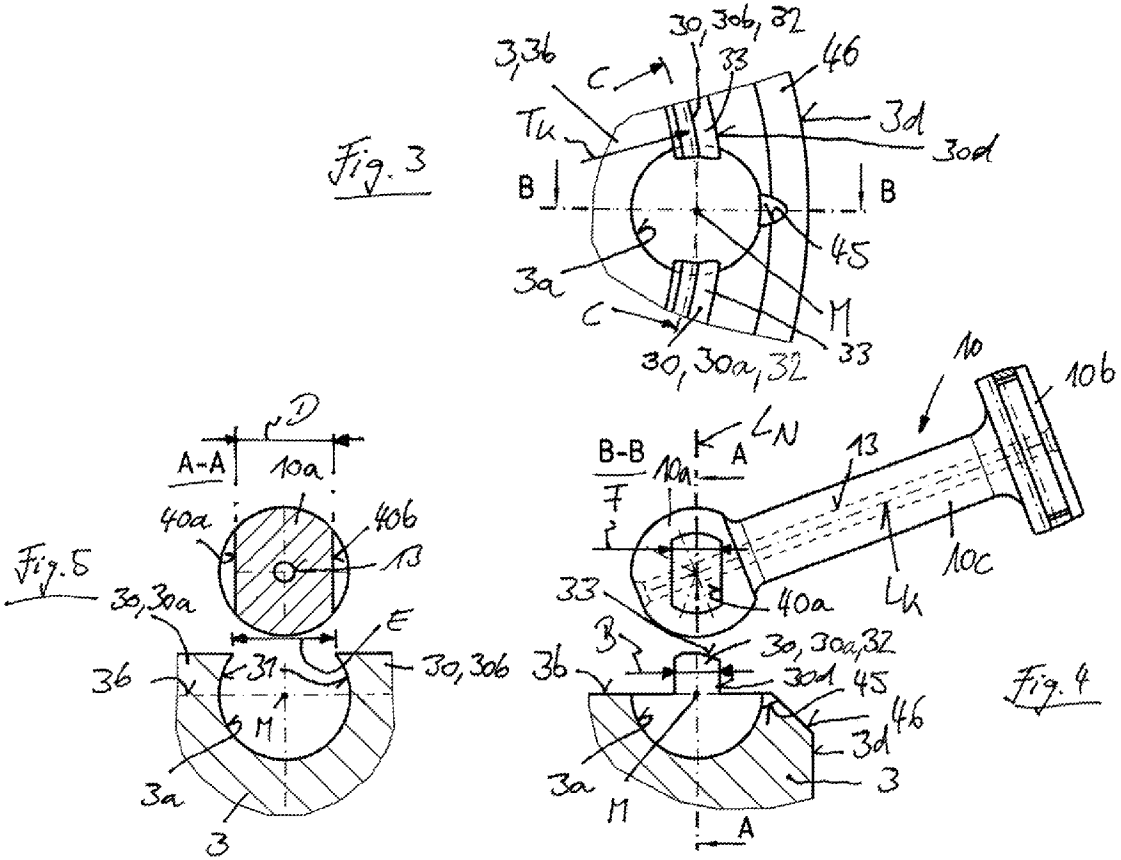
FIG. 3 is a plan view of the end surface of the drive flange.
FIG. 4 is a section along line B-B in FIG. 3.
FIG. 5 is a section along line A-A in FIG. 4.

On the axial piston machine 1 employing the bent-axis construction (as illustrated in greater detail in FIGS. 3 to 5) the spherical cap-shaped receptacle sockets 3*a* are each in the shape of hemispheres that extend only to the equator of the ball. The centers M of the spherical shell-shaped receptacle sockets 3*a* (hemispheres) therefore lie in the plane generated by the end surface 3*b* of the drive flange 3. The spherical cap-shaped receptacle sockets 3*a* in the form of hemispheres wrap around the ball head 10*a* by 180°. FIG. 3 shows a plan view of the end surface 3*b* of the drive flange 3 in the vicinity of a receptacle socket 3*a* (the corresponding piston 10 is not shown).

To positively secure the ball heads 10*a* of the pistons 10 in the hollow spherical shaped receptacle sockets 3*a* (hemispheres), a retaining web 30 is formed on the end surface 3*b* of the drive flange 3 in the vicinity of the receptacle sockets 3*a* and, as illustrated in FIG. 5, extends beyond the ball equator of the hemisphere to wrap around and grasp the ball head 10*a* over an angle of greater than 180°. The retaining web 30 is provided on the inner contour with a ball contour 31 that continues the spherical contour of the spherical cap-shaped receptacle sockets 3*a*.

The retaining web 30 forms two retaining segments 30*a*, 30*b* on each receptacle socket 3*a* which, as illustrated in FIGS. 3 and 5, are located opposite each other on the receptacle socket 3*a* and are each provided with the ball contour 31.

The retaining web 30 is formed by a circular ring-shaped encircling elevation 32 on the end surface 3*b* of the drive flange 3. The circular ring-shaped elevation 32, and thus the retaining web 30, are concentric to the axis of rotation $R_t$ of the drive flange 3, so that the center of the circular ring-shaped elevation 32 that forms the retaining web 30 is located on the axis of rotation $R_t$ of the drive flange 3.

The circular ring-shaped elevation 32 is located on the end surface 3*b* of the drive flange 3 in the vicinity of a reference circle diameter $T_k$ on which the centers M of the hemispheric shaped receptacle sockets 3*a* are located.

The circular ring-shaped elevation 32 is located facing the cylinder barrel 7 on the end surface 3*b* of the drive flange 3.

The retaining web 30 has a width B in the radial direction that is significantly less than the diameter of the hemisphere, for example, a maximum of ⅓ of the diameter of the hemisphere and, thus, of the diameter of the ball head 10*a*. The radially outside peripheral surface 30*d* of the retaining web 30 is at a radially inward distance from the radially outside peripheral surface 3*d* of the drive flange 3.

In the illustrated exemplary embodiment, the retaining web 30 is formed in one piece on the end surface 3*b* of the drive flange 3. The contour of the drive flange 4 is therefore provided with the retaining web 30 and thus the ring-shaped elevation 32 that projects out of the end surface 3*b*. Preferably, the retaining web 30 is formed as early as on a blank of the drive flange 3 with a certain amount of excess material so that the contour of the retaining web 30 can be economically produced in a lathe turning operation of the drive flange 3.

Figure 2:
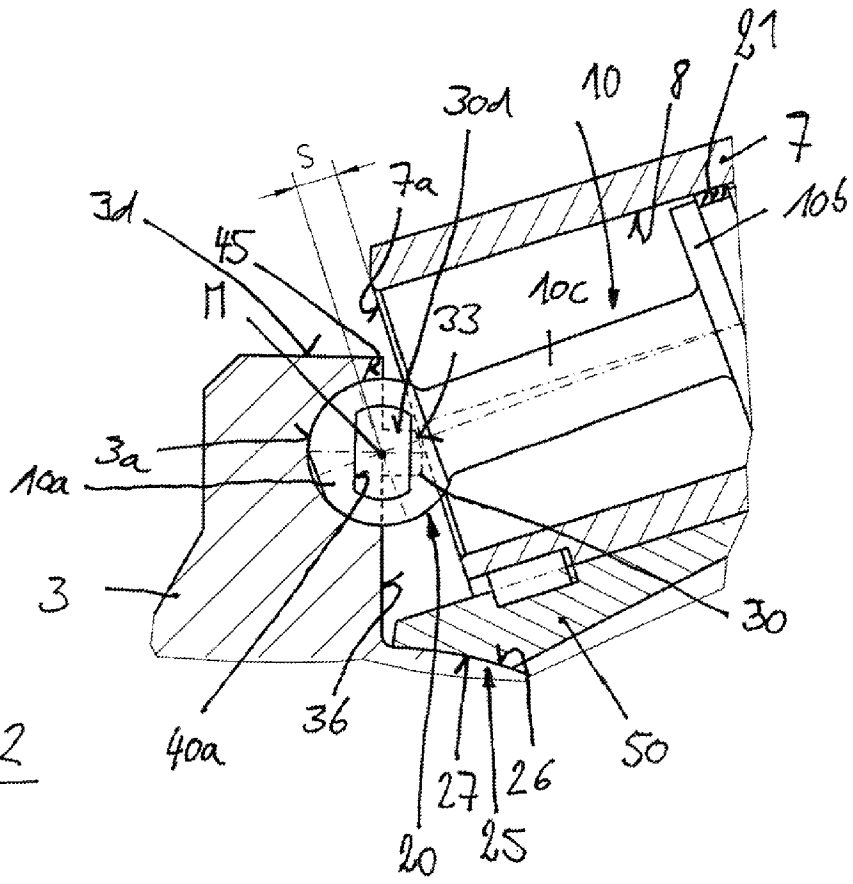
FIG. 2 is an enlarged detail from FIG. 1.

In the axial piston machine 1, the retention of the piston heads 10*a* in the hemispheric shaped receptacle sockets 3*a* is limited to the area of the retaining web 30. Because the encircling retaining web 30 is at some distance radially inwardly from the radially outer peripheral surface 3*d* of the drive flange 3, an open space is created that makes it possible to bring the cylinder barrel 7 with the end surface 7*a* containing the piston outlet openings close to the end surface 3*a* of the drive flange 3, so that it becomes possible for the axial piston machine 1 to have compact dimensions in the axial direction of the longitudinal axis L. FIG. 2 illustrates one possible small distance s between the cylinder barrel 7 containing the end surface 7*a* containing the piston outlet openings and the centers M of the hemispheric receptacle sockets 3*a* which are located on the end surface 3*b* of the drive flange. To achieve the smallest possible distance s, the end surface of the retaining web 30 facing the cylinder barrel 7 is provided in the radially outer area with a bevel 33 that is inclined toward the end surface 3*b* of the drive flange 3.

To be able to introduce the pistons 10 with the piston heads 10*a* into the receptacle sockets 3*a*, each ball head 10*a* (as illustrated in FIG. 5) is provided with two grooves 40*a*, 40*b* located opposite each other. The grooves 40*a*, 40*b* are places where material has been removed from the ball surface in the vicinity of the equator area of the ball heads 10*a*. The distance D between the cylindrical groove bases of the two grooves 40*a*, 40*b* oriented parallel to one another is less than the opening width E between the two retaining segments 30*a*, 30*b* of the retaining web 30 on the respective receptacle socket 3*a*.

The groove widths F of the grooves 40*a*, 40*b* (as illustrated in FIG. 4) are each greater than the width B of the retaining web 30.

The grooves 40*a*, 40*b* are inclined on the ball head 10*a* with a longitudinal axis $L_N$ with respect to the longitudinal axis $L_K$ of the piston 10. In the illustrated exemplary embodiment, the longitudinal axis $L_N$ of the grooves 40*a*, 40*b* is inclined with respect to the longitudinal axis $L_K$ of the piston 10 by an angle of inclination $\beta_M$ that forms an installation angle $\beta_M$. The installation angle $\beta_M$ is less than 90°.

In FIGS. 1 to 11*a*, the grooves 40*a*, 40*b* run in a straight line.

The angle of inclination $\beta_M$ of the grooves 40*a*, 40*b* is such that the angle of inclination $\beta_M$ for the installation of the pistons 10 is different from the maximum tilting angles 131 of the pistons 10 that occur during operation of the axial piston machine 1.

For installation of the pistons 10 into the receptacle sockets 3*a*, on the drive flange 3 on each receptacle socket 3*a* there is a recess 45 for the piston rod 10*c* of the piston 10. In the illustrated exemplary embodiment, the recesses 45 are located on the radially outer portion of the receptacle sockets 3*a* in the end surface 3*b* of the drive flange 3 and extend from the receptacle socket 3*a* radially outwardly toward the radially outer peripheral surface 3*d* of the drive flange 3. The recesses 45, viewed looking inwardly in the radial direction, have a depth that increases starting from the radially outer peripheral surface 3*d* toward the receptacle socket 3*a*.

On the outer edge between the radially outer peripheral surface 3*d* and the end surface 3*b*, the drive flange 3 is also provided with a bevel 46. The recesses 45 extend into the area of the bevel 46.

The process of installing the pistons 10 into the receptacle sockets is illustrated in greater detail in FIGS. 6*a* to 8*d*. The indices "a" to "d" in FIGS. 6*a* to 8*d* correspond to the same installation positions.

Figures 6A, 6B, 6C, 6D:
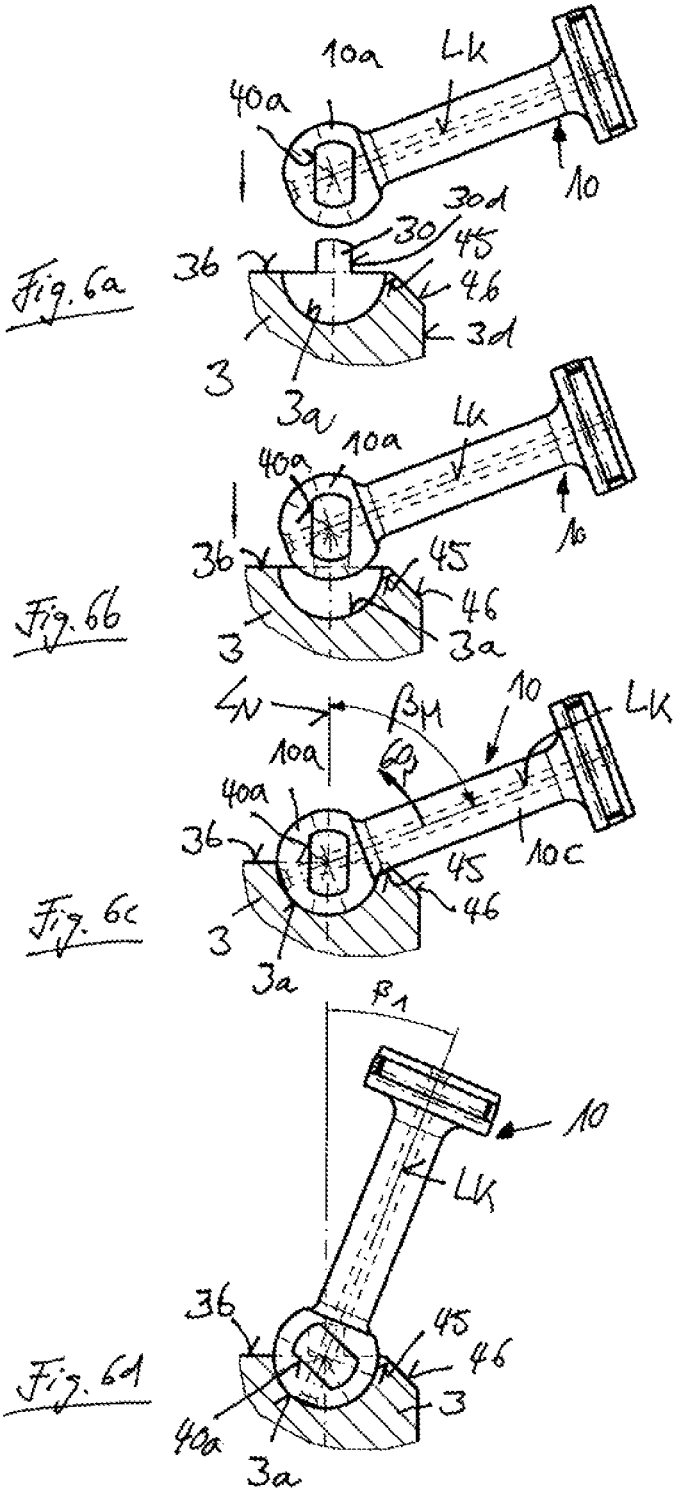
FIGS. 6*a*-6*d* are illustrations illustrating the installation of the pistons.
Figures 7A, 7B, 7C, 7D, 8A, 8B, 8C, 8D:
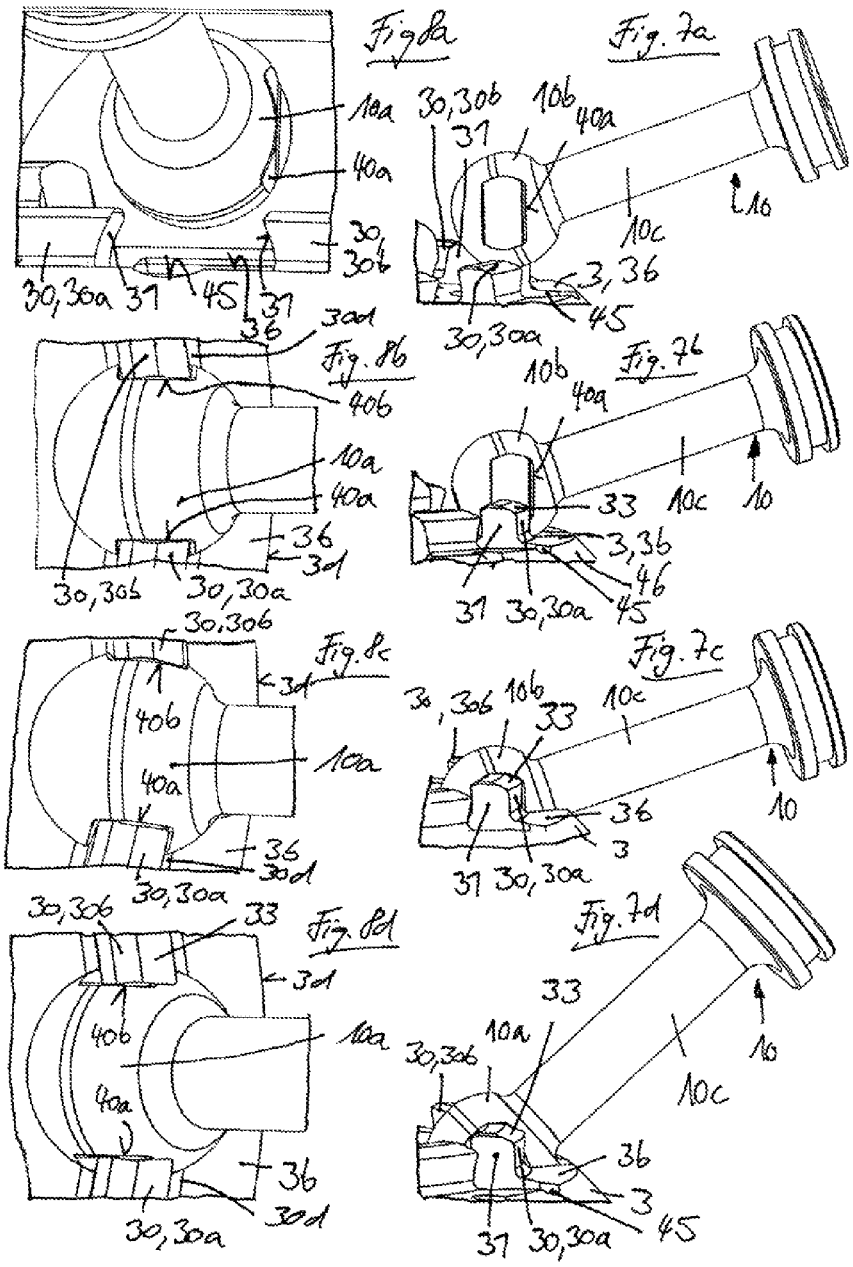
FIGS. 7*a*-7*d* are views in perspective illustrating the installation of the pistons.
FIGS. 8*a*-8*d* are additional views in perspective illustrating the installation of the pistons.
Figure 9A:
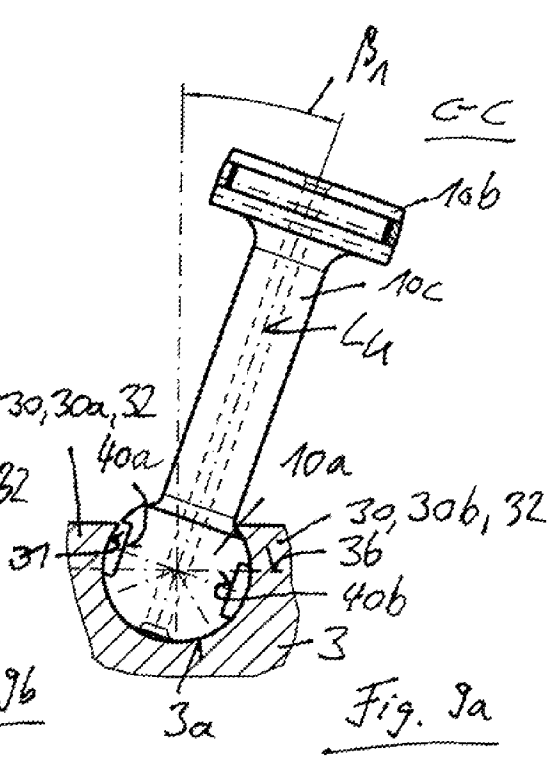
FIGS. 9*a*-9*c* are multiple views along a line C-C in FIG. 3 at different angles of inclination of the pistons.
Figure 9B:
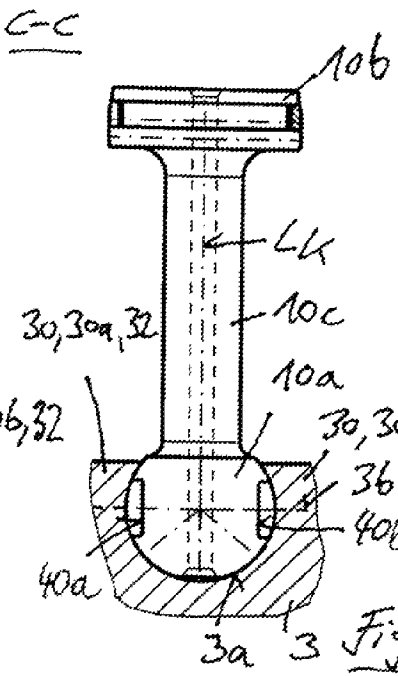
Figure 9C:
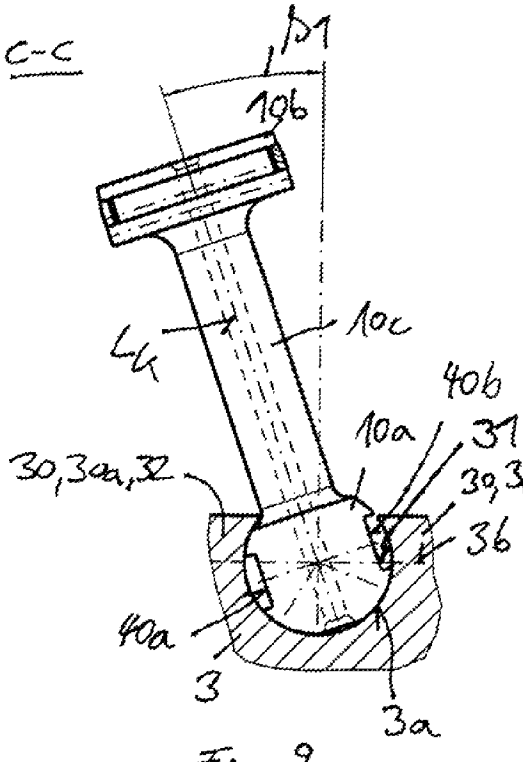

For installation of the piston 10 in the receptacle socket 3*a*, the piston 10 is introduced into the receptacle socket 3*a* at the installation angle $\beta_M$ illustrated in FIGS. 6*a*, 7*a*, and 8*a*. Because when the pistons 10 are tilted at the installation angle $\beta_M$ the longitudinal axis $L_N$ of the grooves 40*a*, 40*b* is oriented parallel to the retaining web 30, the piston 10 with the two grooves 40*a*, 40*b* can be inserted into the receptacle socket 3*a* between the two retaining segments 30*a*, 30*b* of the retaining web 30, as illustrated in FIGS. 6*b*, 7*b*, 8*b*, and 6*c*, 7*c*, 8*c*. When the piston 10 is inserted all the way into the receptacle socket 3*a* at the installation angle $\beta_M$, the piston rod 10*b* comes into contact with the recess 45. If the ball head 10*a* has been introduced all the way into the receptacle socket 3*a*, the piston can be tilted back starting from the installation angle $\beta_M$ to the angle of inclination $\beta_1$ (as illustrated in FIG. 6*c* by the arrow 60 and in FIGS. 6*d*, 7*d*, and 8*d*) so that the ball head 10*a* is positively secured in the receptacle socket 3*a* by the retaining web 30.

During operation of the axial piston machine 1, the maximum tilting angles β1 occur on the pistons 10 (as illustrated in FIGS. 6*d* and 9*a* to 9*c*) so that the piston head 10*a* is reliably secured in the receptacle socket 3*a* during operation of the axial piston machine 1.

Figure 10A:
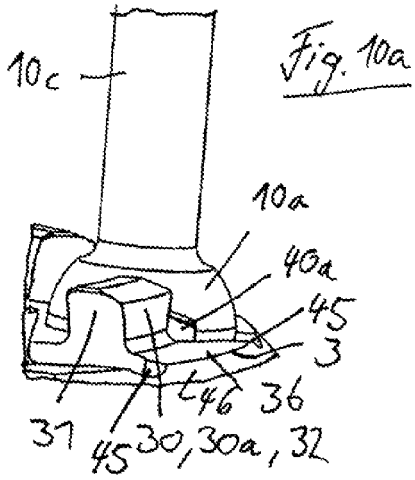
FIGS. 10*a*-10*c* are multiple views in perspective of a piston installed in the receptacle socket.
Figure 10B:
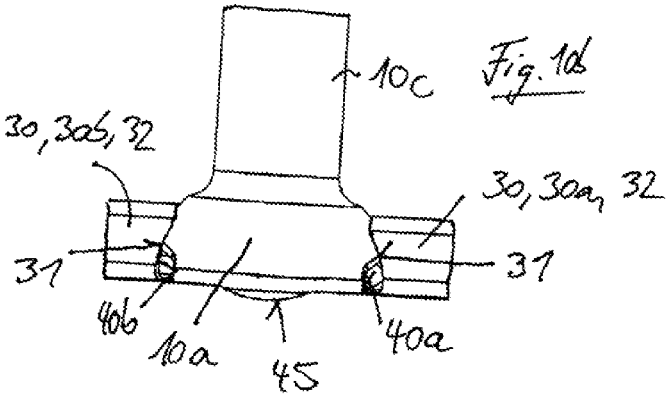
Figure 10C:
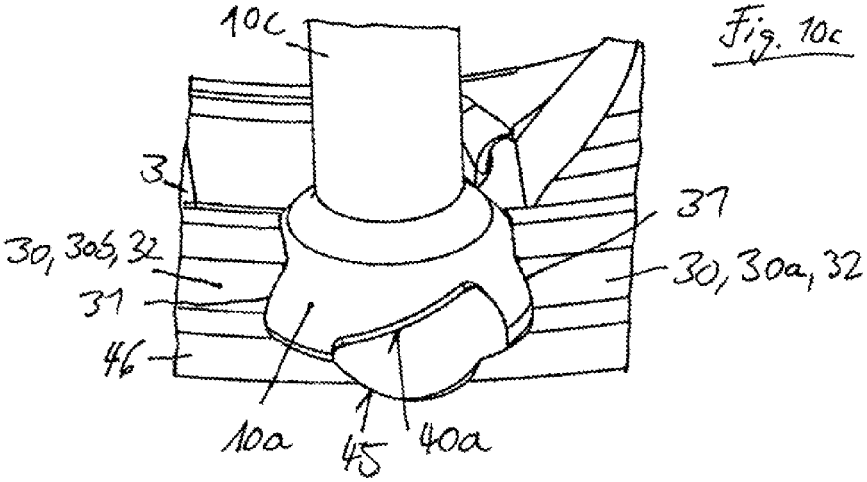

FIGS. 10*a* to 10*c* are views in perspective of the pistons 10 secured in the receptacle socket 3*a*.

Figure 11A:
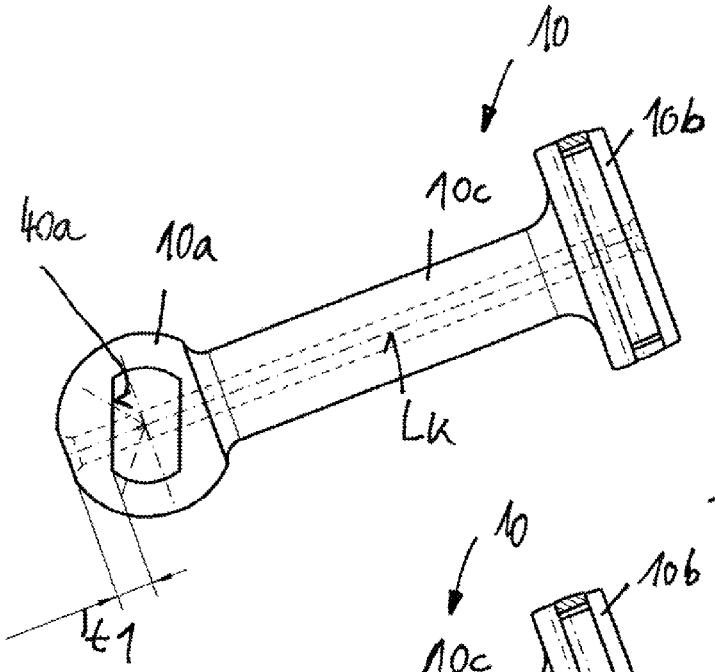
FIG. 11*a* shows a first embodiment of a piston.
Figure 11B:
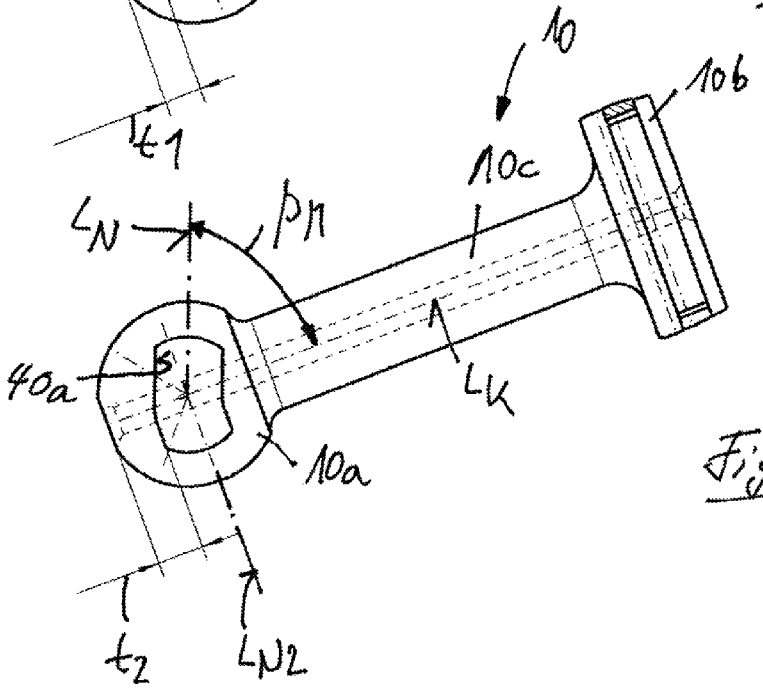
FIG. 11*b* shows a second embodiment of the piston.

FIG. 11*b* illustrates a second embodiment of a piston 10 in which the grooves 40*a*, 40*b* in the piston head 10*a* follow a bent path. The grooves 40*a*, 40*b* have a first segment oriented with a longitudinal axis $L_N$ at the angle of inclination $\beta_M$ at an inclination with respect to the longitudinal axis $L_K$ of the piston 10. A second segment of the grooves 40*a*, 40*b* is also bent with respect to the first segment and in the illustrated exemplary embodiment is oriented with a longitudinal axis $L_{N2}$ perpendicular to the longitudinal axis $L_K$ of the piston 10. Because of the bent second segment of the grooves 40*a*, 40*b*, the ball end of the ball head 10*a* that is opposite the piston shaft 10*c* has a dimension t2 from the outer edge of the grooves 40*a*, 40*b* that is greater than the dimension t1 of a straight path of the grooves 40*a*, 40*b* (FIG. 11*a*), so that the load-bearing ball half that is opposite the piston rod 10*c* and transmits the piston forces in the receptacle socket 3*a* has an enlarged surface area.

The invention has a series of advantages.

The locking of the pistons 10 of the invention in the receptacle sockets 3*a*, on account of the hemispheric shaped receptacle sockets 3*a* and the retaining web 30 on the end surface 3*b* of the drive flange 3, which projects out of the end surface 3*b* of the drive flange 3, requires little extra manufacturing effort or expense. In addition, a compact axial dimension of the axial piston machine of the invention can be achieved with the locking of the piston 10 in the drive flange 3 of the invention. As a result of the presence of the two inclined grooves 40*a*, 40*b*, the locking of the pistons 10 is appropriate for use on variable displacement machines with a variable displacement volume and makes pivoting angles of 0° possible. The two grooves 40*a*, 40*b* on the piston heads 10*a*, compared to flattened areas on the piston heads 10*a* to manufacture cylindrical surfaces, on account of the small groove width F of the grooves 40*a*, 40*b*, results in a slight reduction of the ball surface area on the load-bearing ball half that is opposite the piston rod 10*c*.

The invention is not limited to the illustrated exemplary embodiments. The axial piston machine 1, instead of being constructed as a variable displacement machine, can alternatively be constructed as a constant displacement machine. In a constant displacement machine, the angle of inclination α of the axis of rotation $R_Z$ of the cylinder barrel 7 is constant and fixed with respect to the axis of rotation $R_t$ of the drive shaft 4. The control surface 15 with which the cylinder barrel 7 is in contact can be formed on the housing 2.

It goes without saying that the bushing 50 can be constructed in one piece with the cylinder barrel 7.

The drive flange 3 can be in the form of a component that is separate from the drive shaft 4 and is connected with the drive shaft 4 in a torque-tight manner.

The bevel 46 on the drive flange 3 can be enlarged so that the additional recesses 45 for the installation of the pistons 10 can be eliminated.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breath of the appended claims and any and all equivalents thereof.

The invention claimed is:

1. A hydrostatic axial piston machine with a bent-axis construction, comprising:

a drive shaft located inside a housing and rotatable around a first axis of rotation ($R_t$), a drive flange located inside the housing and rotatable around the first axis of rotation ($R_t$), a cylinder barrel located inside the housing and rotatable around a second axis of rotation ($R_z$), wherein the cylinder barrel includes a plurality of piston bores, a longitudinally displaceable piston located in each piston bore, wherein the pistons are fastened in an articulated manner to the drive flange; and ball joints for articulated fastening of the pistons to the drive flange, wherein the ball joints include a spherical cap-shaped receptacle socket in an end surface of the drive flange and a ball head operatively connected with the piston, wherein the receptacle sockets comprise hemispheres that extend to a ball equator, and wherein on an end surface of the drive flange, in a vicinity of the receptacle sockets, there is a retaining web that extends beyond the ball equator of the hemisphere to grip the ball head at an angle of greater than 180°, and wherein the retaining web on each receptacle socket forms two retaining segments that are located opposite each other on the receptacle socket, and extend beyond the hemisphere.

2. The hydrostatic axial piston machine as recited in claim 1, wherein the retaining web comprises a circular ring-shaped elevation on the end surface of the drive flange.

3. The hydrostatic axial piston machine as recited in claim 1, wherein a center of the retaining web is located on the first axis of rotation ($R_t$) of the drive flange.

4. The hydrostatic axial piston machine as recited in claim 1, wherein the retaining web is located in a vicinity of a reference circle, on which centers of the hemispheres are located.

5. The hydrostatic axial piston machine as recited in claim 1, wherein the retaining web is one piece with the end surface of the drive flange.

6. The hydrostatic axial piston machine as recited in claim 1, wherein the ball head includes two grooves located opposite each other, wherein a distance between groove bases of the two grooves is less than an aperture width of the two retaining segments on the respective receptacle socket.

7. The hydrostatic axial piston machine as recited in claim 6, wherein a groove width of the grooves is greater than a width of the retaining web.

8. The hydrostatic axial piston machine as recited in claim 6, wherein the grooves are located on the ball head at an inclination with respect to a longitudinal axis of the piston.

9. The hydrostatic axial piston machine as recited in claim 8, wherein the angle of inclination of the grooves is such that the angle of inclination is different from tilting angles of the pistons that occur during operation of the axial piston machine.

10. The hydrostatic axial piston machine as recited in claim 1, wherein a recess for a piston rod of the piston is located on the drive flange on each receptacle socket.

11. The hydrostatic axial piston machine as recited in claim 1, wherein a spherical guide for guidance of the cylinder barrel is located between the drive flange and the cylinder barrel.

12. The hydrostatic axial piston machine as recited in claim 10, wherein the recess is formed in a radially outer area of the receptacle socket in the end surface of the drive flange.

13. The hydrostatic axial piston machine as recited in claim 10, wherein the drive flange includes a bevel on an outer edge of an end surface, wherein the bevel forms the recess for the piston rod of the piston.

14. The hydrostatic axial piston machine as recited in claim 6, wherein the grooves are aligned in a straight-line path.

15. The hydrostatic axial piston machine as recited in claim 6, wherein the grooves are aligned in a bent path.

16. The hydrostatic axial piston machine as recited in claim 15, wherein the grooves have a first segment that is inclined with respect to a longitudinal axis of the piston, and a second segment that is bent with respect to the first segment and is oriented perpendicular to the longitudinal axis of the piston.

* * * * *